US006290229B1

(12) United States Patent
Perez

(10) Patent No.: US 6,290,229 B1
(45) Date of Patent: Sep. 18, 2001

(54) CUSTOMER SUPPORT DEVICE FOR A GAMING MACHINE

(75) Inventor: Elizabeth Perez, Miami, FL (US)

(73) Assignee: The Miccosukee Tribe of Indians of Florida, Miami, FL (US)

( * ) Notice: Subject to any disclaimer, the term of this patent is extended or adjusted under 35 U.S.C. 154(b) by 0 days.

(21) Appl. No.: 09/466,958

(22) Filed: Dec. 20, 1999

(51) Int. Cl.[7] ..... A63F 11/00
(52) U.S. Cl. ..... 273/148 R; 273/148 B
(58) Field of Search ..... 273/148 R, 148 B

(56) References Cited

U.S. PATENT DOCUMENTS

| | | | | |
|---|---|---|---|---|
| D. 249,712 | | 9/1978 | Dolezal | D27/21 |
| 3,559,869 | * | 2/1971 | Reynolds . | |
| 4,087,126 | | 5/1978 | Wynn | 296/37.8 |
| 4,169,481 | * | 10/1979 | Hultberg . | |
| 4,270,724 | | 6/1981 | McMullen | 248/534 |
| 4,286,742 | | 9/1981 | Pellegrino | 224/281 |
| 4,846,333 | * | 7/1989 | Kissick . | |
| 4,858,796 | * | 8/1989 | Roth . | |
| 4,896,611 | * | 1/1990 | Lorenzini . | |
| 4,942,328 | * | 7/1990 | Price . | |
| 4,953,772 | * | 9/1990 | Phifer . | |
| 5,205,452 | * | 4/1993 | Mankey . | |
| 5,221,032 | * | 6/1993 | Bott . | |
| 5,335,787 | * | 8/1994 | Finchum . | |
| 5,487,519 | | 1/1996 | Grabowski | 248/311.2 |
| 5,533,772 | | 7/1996 | Volkers et al. | 296/37.9 |
| 5,667,180 | | 9/1997 | Duckworth | 248/311.2 |
| 5,887,940 | * | 3/1999 | Anderson . | |
| 5,906,348 | * | 5/1999 | Orenstein . | |

* cited by examiner

*Primary Examiner*—Benjamin H. Layno
*Assistant Examiner*—Vishu K. Mendiratta
(74) *Attorney, Agent, or Firm*—Sutherland Asbill & Brennan LLP

(57) ABSTRACT

A support device for a gaming machine. The support device includes a base with a drink holder and a dish positioned within the base. The base is fixedly attached to the gaming machine such that the drink holder and the dish are accessible to a user of the gaming machine.

16 Claims, 4 Drawing Sheets

CUSTOMER SUPPORT DEVICE FOR A GAMING MACHINE

TECHNICAL FIELD

The present invention relates generally to a support attachment for a gaming machine and more particularly relates to a combination drink holder and ashtray attached to a slot machine.

BACKGROUND OF THE INVENTION

As casinos become more and more popular throughout the country, casino operators are attempting to make the casinos as "user friendly" as possible while also maximizing the profitability of the casino. Casinos generally offer different types of refreshments and entertainment. The refreshments may include various types of beverages, cigarettes, and cigars, and the like. Casinos traditionally have offered complimentary refreshments to their preferred or regular customers. The casino entertainment generally includes gaming activities such as black jack, baccarat, and other types of card games; roulette; craps; and also various types of gaming devices. These gaming devices may include slot machines, poker machines, and numerous other types of electronic or mechanical devices.

As is well known, a slot machine is a coin or token operated gaming machine that pays off according to the matching of symbols on wheels spun by a handle. Of course, most slot machines today are electronically based with the payoff determined by the matching of symbols as shown on an electronic display. It is not uncommon for a customer to hold a large number of coins or tokens while playing a slot machine. The customer either bringing the coins or tokens with him or her to begin playing a particular machine or the customer may win a large number of coins or tokens. It also is not uncommon for a customer to play one particular slot machine for an extended amount of time. This continued play is done on the belief that the customer's odds of winning a jackpot increase with each coin or token.

Casinos desire that their customers play such gaming devices for as long as possible while being as comfortable as possible. One drawback with the current design of slot machines and other types of gaming devices is that the customer may not have a free hand while playing the gaming device to partake of the casinos' refreshments. In other words, the customer may not have a free hand for a drink, a cigarette, a cigar, and the like while playing the gaming device. For example, most slot machines simply do not have a flat ledge designed to accommodate a drink or an ashtray. Although a casino may generate a significant amount of revenue from the sale of beverages, cigarettes, cigars, and the like, the casino and its customers would prefer for the customer to stay at the gaming device rather than spending time in the bar. Likewise, the customer may not want to leave a particular slot machine on the belief that a jackpot is imminent.

What is needed, therefore, is a means by which a customer playing a slot machine or other type of gaming device can enjoy a beverage, cigarette, cigar, and the like. The customer can enjoy the refreshments, while also holding his or her coins or tokens, without having to leave the gaming device. These goals must be accomplished in a cost efficient manner that does not distract the customer from the slot machine or other type of gaming device.

SUMMARY OF THE INVENTION

The present invention provides a support device for a gaming machine. The support device includes a base with a drink holder and a dish positioned within the base. The base is fixedly attached to the gaming machine such that the drink holder and the dish are accessible to a user of the gaming machine.

Specific embodiments include the use of the dish as an ashtray or a coin holder. The ashtray may include a support frame surrounding the dish with the dish being mounted to the support frame by one or more hinges for rotation therewith. The base and the drink holder may be made from a metal blank. The metal may be a stainless steel or other type of noncorrosive materials. The drink holder may include a rubber base.

A further embodiment of the present invention provides a gaming device for use in a casino. The gaming device includes a cabinet with a base fixedly attached thereto. A drink holder and a dish are positioned within the base. The gaming device may be a slot machine or similar device.

The method of the present invention provides for the use of a slot machine. The method includes the steps of attaching a refreshment base to the slot machine, offering refreshments to a customer positioned adjacent to the slot machine, and providing the refreshments to the customer while the customer is positioned adjacent thereto. The refreshment base may include a drink holder and an ashtray. The refreshments may be beverages, cigarettes, cigars, or the like. The method may further include the steps of the customer playing the slot machine while consuming the refreshments and placing the beverage, the cigarettes, the cigars, or the like in the drink holder.

It is thus an object of the present invention to provide a customer support device for a gaming device such as a slot machine.

It is a further object of the present invention to provide a drink holder for use with a gaming device such as a slot machine.

It is yet a further object of the present invention to provide an ashtray for use with a gaming device such as a slot machine.

It is yet another object of the present invention to provide a coin holder for use with a gaming device such as a slot machine.

It is a still further object of the present invention to provide a customer with the ability to play a gaming device such as a slot machine while also enjoying beverages, cigarettes, cigars, and the like.

Other objects, features, and advantages of the present invention will become apparent upon review of the following detailed description of the preferred embodiments of the invention, when taken in conjunction with the drawings and the appended claims.

DETAILED DESCRIPTION OF THE INVENTION

Figure 1:
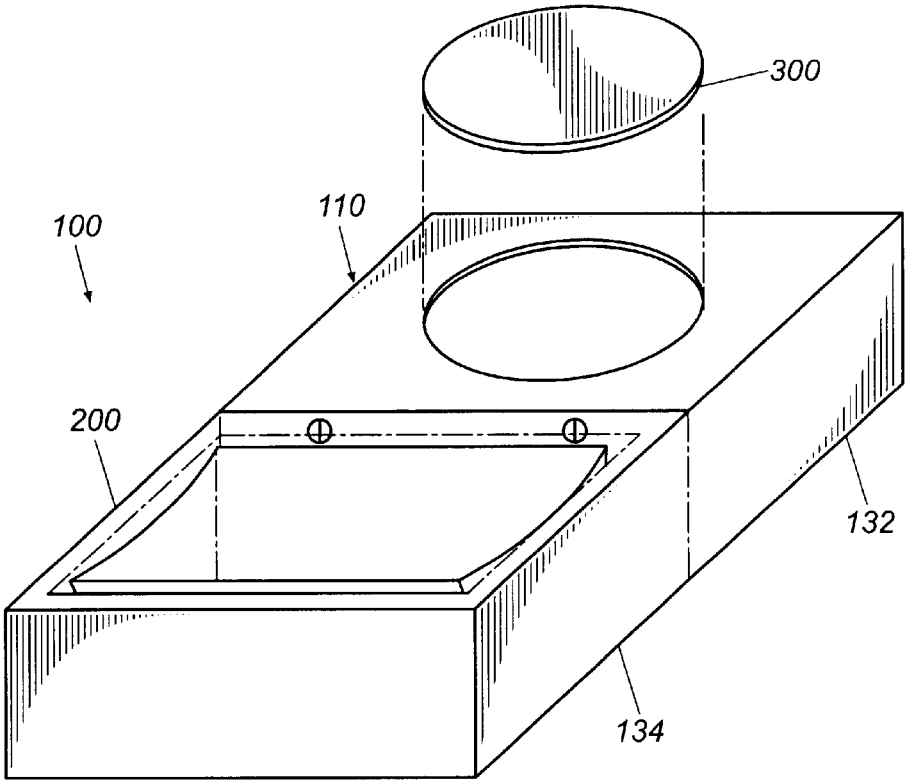
FIG. 1 is a perspective view of the support device of the present invention.
Figure 2:
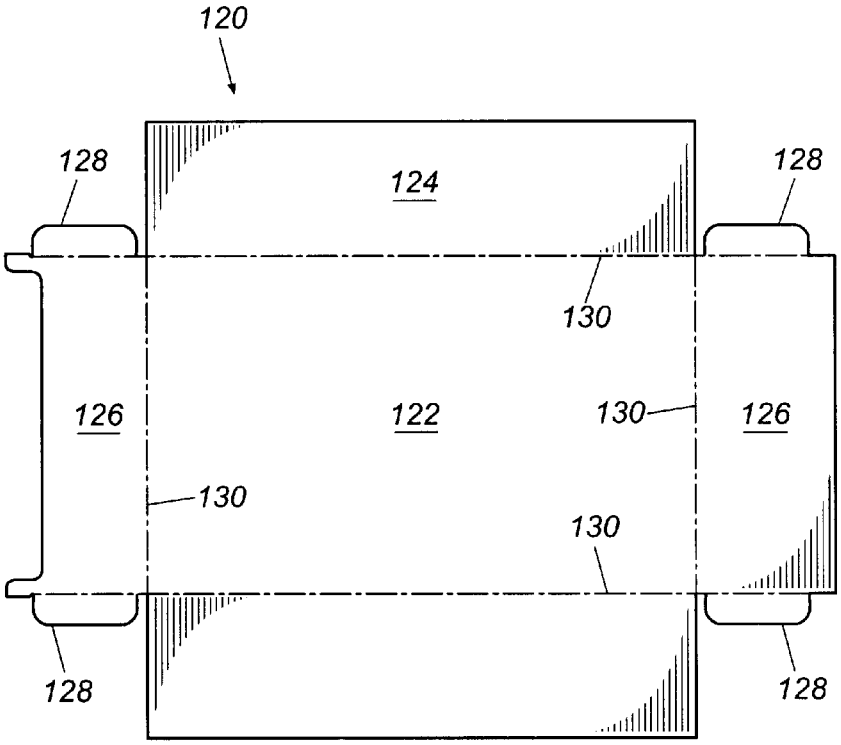
FIG. 2 is a plan view of a metal blank used for the base of the present invention.
Figure 3:
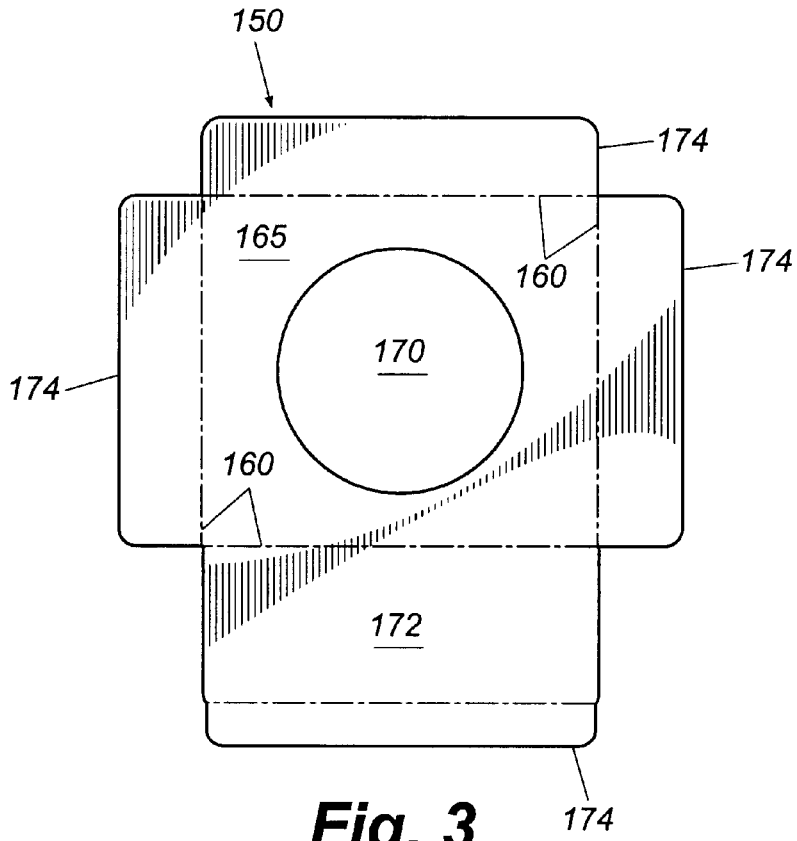
FIG. 3 is a plan view of a metal blank used for the drink holder of the present invention.
Figure 4:
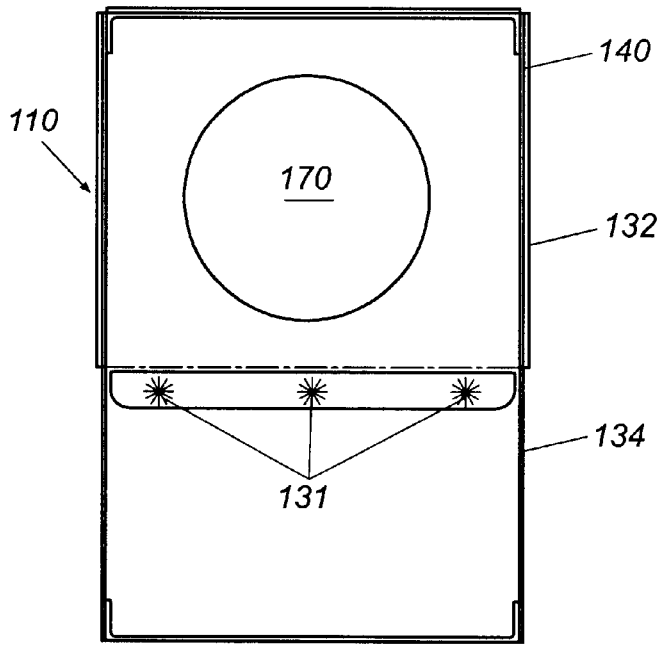
FIG. 4 is a plan view of the top of the support device of the present invention.
Figure 5:
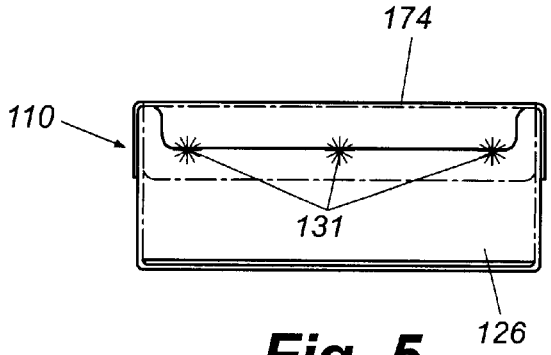
FIG. 5 is a plan view of a first side of the support device of the present invention.
Figure 6:
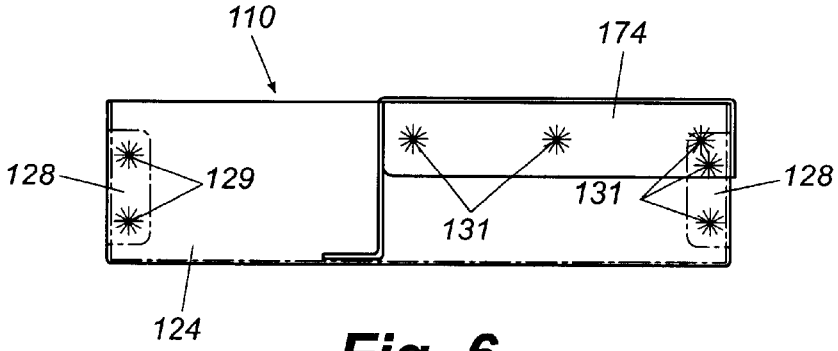
FIG. 6 is a plan view of a second side of the support device of the present invention.

Referring now to the drawings in which like numerals refer to like parts throughout the several views, FIGS. 1–6 show the support device 100 of the present invention. The support device 100 includes a base 110. The base 110 may be constructed from stainless steel or other types of substantially non-corrosive metals, alloys, or similar materials. The base 110 also may be coated or treated with a non-corrosive outer layer so as to protect the base 110 against spills and cigarette burns. The base 110 may be made from a single metal blank 120 as is shown in FIG. 2. The blank 120 may form a bottom element 122, a plurality of sidewalls 124, and a plurality of end walls 126 with extending flaps 128. The blank 120 is stamped or cut from a single sheet of metal and folded into shape along dashed lines 130. The flaps 128 are then fixedly attached to the side walls 124 of the base 110 by a plurality of spot welds 131 or by other conventional types of fastening means such as screws, bolts, and the like. When the blank 120 is assembled, the base 110 forms a first end 132 and a second end 134.

The support device 100 also may include a drink holder insert 140. The drink holder insert 140 is preferably made from the same materials as the base 110. If made of metal, the drink holder insert 140 is also formed from a blank 150. The blank 150 is also stamped or cut from a single piece of metal. The blank 150 is then folded along the dashed lines 160. The blank 150 may include a top element 165 with a central aperture 170, a sidewall 172, and a plurality of flaps 174. After the sidewall 172 and the flaps 174 are folded, the drink holder insert 140 is positioned within the base 110 at the first end 132 and fixedly attached by the spot welds 131 or by other conventional fastening means such as screws, bolts, and the like.

As an alternative, the base 110 and the drink holder insert 140 may be made from a substantially rigid polymer or similar materials. For example, the base 110 and the drink holder insert 140 may be made from injection molding or other types of conventional manufacturing methods. The base 110 and the drink holder insert 140 also may be manufactured as a unitary element as opposed to several elements.

Figure 7:
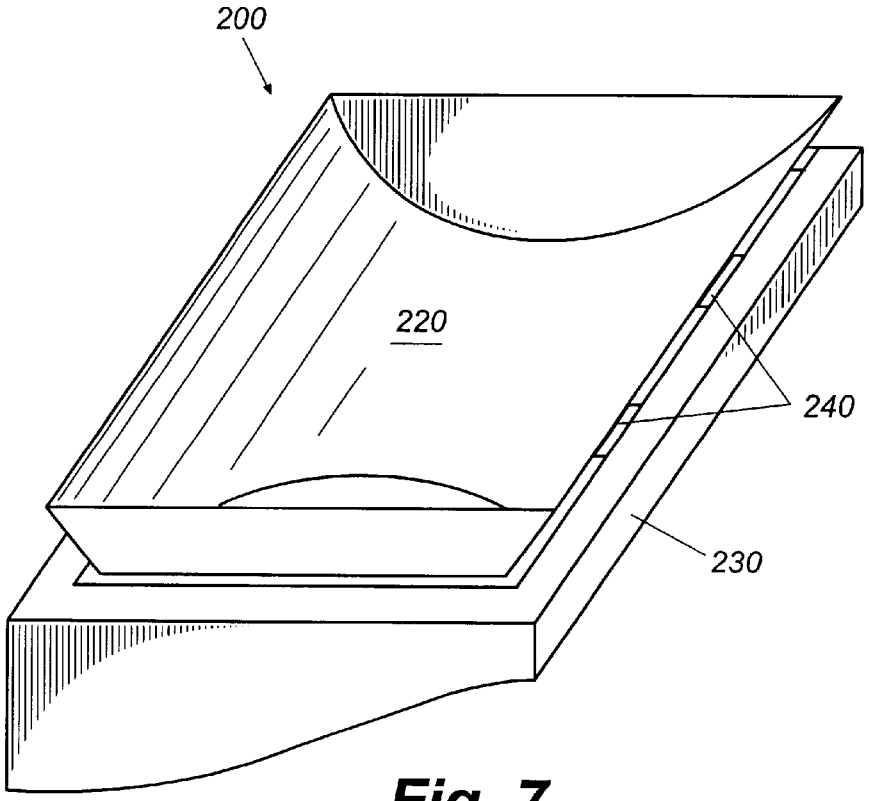
FIG. 7 is a perspective view of an ashtray for use with the present invention.

The second end 134 of the base 110 forms a compartment that may have numerous uses. As is shown in FIG. 1, an ashtray 200 may be positioned therein. As is shown in FIG. 7, the ashtray 200 may be of conventional design. The ashtray 200 may include a central dish 220 with a supporting frame 230. The dish 220 may rotate about the supporting frame 230 via one or more hinges 240 or by other types of conventional mechanisms. By allowing the dish 220 to rotate, the dish 220 may be easily cleaned of ashes and the like. The dish 220 is preferably made from stainless steel or other type of noncorrosive, fire retardant material. For example, the dish 220 may be made of a substantially rigid, fire retardant glass, ceramic, polymer, or similar materials. The supporting frame 230 may be made of similar materials or may be made as the same or similar materials as the base 110. The supporting frame 230 is positioned within the second end 134 of the base 110. The supporting frame 230 may be removably attached for easy cleaning or the supporting frame 230 may be fixedly attached via the spot welds 131, or by screws, bolts or other conventional fastening means. Alternatively, the base 110 and the dish 220 may be a unitary element.

In addition to use as an ashtray, the dish 220 may be used for any number of other purposes. For example, the dish 220 may be used for holding coins or tokens for the customer. Further, the dish 220 may be used to hold other types of refreshments such as candy and the like. The second end 134 of the base 110 also could accommodate a second drink holder insert 140.

Figure 8:
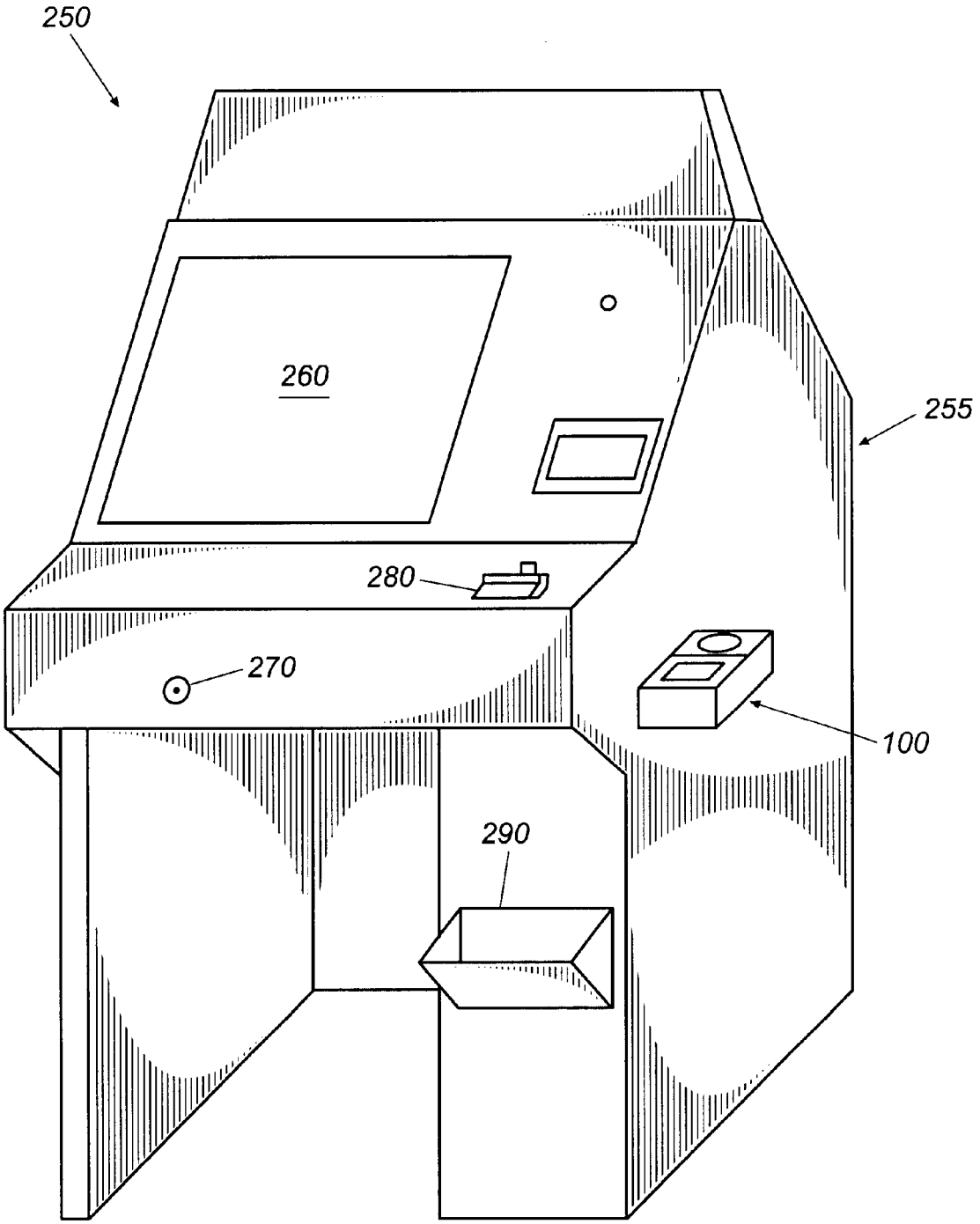
FIG. 8 is a perspective view of a slot machine with the support device of the present invention.

FIG. 8 shows the use of the support device 100 with a conventional gaming device such as a slot machine 250. The slot machine 250 is of conventional design. The slot machine 250 includes a cabinet 255 with a video screen 260, an activation button 270, a coin or token slot 280, and a coin or token return 290. Alternatively, a smart card reader may be used for both the coin and token slot 280 and the coin or token return 290. By way of example, the slot machine 250 may be a conventional slant top model. Alternatively, any type of electronic or mechanical gaming device, such as a poker machine, video game, pin ball game, and the like may be used.

The support device 100 may be fixedly attached to the slot machine 250 by screws, bolts, or other conventional fastening means. The edge between the support device 100 and the slot machine 250 may be sealed by conventional glues, caulks, or other sealants to prevent moisture from penetrating therein. Preferably, the support device 100 will be attached to the side of the slot machine 250, but the support device 100 may be attached at any convenient location thereon that does not interfere with operation of the slot machine 250. The support device 100 is positioned for easy access by the customer to his or her beverage, cigarette, cigar, and the like while playing the slot machine 250. Likewise, the casino staff should have access to the support device 100 when, for example, delivering or removing drinks. A rubber disk 300 may be installed within the aperture 170 of the drink holder insert 140 to cushion the placement of drinks therein.

In use, the customer can play the slot machine 250 while enjoying a beverage, a cigarette, or cigar. The customer can place his or her drinks within the aperture 170 of the drink holder insert 140 and his or her cigarette or cigar in the dish 220 of the ashtray 210. Alternatively, the dish 220 may be used to hold coins or tokens or other items such as candy and other refreshments. The customer can continue playing the slot machine 250 while enjoying his or her beverage or other item without the need to leave the slot machine 250. The casino staff can serve the customer as the customer continues to play the slot machine 250 or other gaming device. The dish 220 of the ashtray 210 is easily cleaned by simply flipping the dish over on its hinges 240.

It should be apparent that the foregoing relates only to the preferred embodiments of the present invention and that numerous changes and modifications may be made without departing from the spirit and scope of the invention as defined by the following claims.

I claim:

1. A gaming device for use in a casino, comprising:

a cabinet;

said cabinet comprising gaming means and an input/output device for funds;

a base fixedly attached to said cabinet by bolts such that said base does not move with respect to said cabinet;

said base protruding outwardly from said cabinet;

said base comprising a stamped, corrosion resistant metal;

a drink bolder positioned within said base; and a dish positioned within said base.

2. The gaming device of claim 1, wherein said dish comprises a coin holder.

3. The gaming device of claim 1, wherein said base comprises a metal blank.

4. The gaming device of claim 1, wherein said drink holder comprises a metal blank.

5. The gaming device of claim 1, wherein said drink holder comprises a rubber base.

6. The support device of claim 1, wherein said base and said drink holder comprise a unitary element.

7. The support device of claim 1, wherein said base and said dish comprise a unitary element.

8. The gaming device of claim 1, wherein said cabinet comprises a slot machine.

9. The support device of claim 1, wherein said dish comprises an ashtray.

10. The support device of claim 9, wherein said ashtray comprises a support frame surrounding said dish.

11. The support device of claim 10, wherein said dish is mounted to said support frame by one or more hinges for rotation therewith.

12. The gaming device of claim 1, wherein said cabinet comprises a poker game.

13. The gaming device of claim 1, wherein said cabinet comprises a standing cabinet.

14. The gaming device of claim 1, wherein said stamped, corrosion resistant metal comprises stainless steel.

15. A slot machine, comprising:

a cabinet;

said cabinet comprising first half and a second half;

said first half of said cabinet comprising a video screen, a coin slot, and a coin return;

said second half of said cabinet comprising a support base;

a refreshment base fixedly attached to said first half of said cabinet such that said base does not move with respect to said cabinet;

said base protruding outwardly from said cabinet;

said refreshment base comprising a stamped, corrosion resistant metal;

a drink holder positioned within said base; and a dish positioned within said base;

said refreshment base positioned such that a player can access said refreshment base while standing at said cabinet and watching said video screen.

16. The slot machine of claim 15, wherein said stamped, corrosion resistant metal comprises stainless steel.

* * * * *